United States Patent [19]

Silverstein

[11] 4,090,033

[45] May 16, 1978

[54] MINIATURE PORTABLE PUBLIC ADDRESS SYSTEM

[75] Inventor: Milton M. Silverstein, San Jose, Calif.

[73] Assignee: J.M.J. Electronics, Inc., Berkeley, Calif.

[21] Appl. No.: 689,259

[22] Filed: May 24, 1976

[51] Int. Cl.[2] ..... H04R 27/00

[52] U.S. Cl. ..... 179/1 AT; 179/1 MG; 179/1 VE

[58] Field of Search ..... 179/1 AT, 1 MG, 1 VE, 179/1 SW

[56] References Cited

U.S. PATENT DOCUMENTS

| | | | |
|---|---|---|---|
| 2,572,221 | 10/1951 | Voight | 179/1 VE |
| 2,983,791 | 5/1961 | Menarik | 179/1 VE |

FOREIGN PATENT DOCUMENTS

| | | | |
|---|---|---|---|
| 1,046,651 | 7/1951 | France | 179/1 VE |

*Primary Examiner*—Kathleen H. Claffy
*Assistant Examiner*—Kenneth A. Chayt
*Attorney, Agent, or Firm*—Boone, Schatzel, Hamrick & Knudsen

[57] ABSTRACT

A portable public address system for use in motor buses which can also be used inside buildings or out-of-doors including a first case and a second case. Within the first case, which is approximately the size of a pack of cigarettes, is an amplifier circuit with a Darlington configuration transistor pre-amplifier, a three-position switch, a volume control and a microphone. Within the second case is a loudspeaker and battery supply which are electrically connected to the amplifier circuit in the first case through the switch.

8 Claims, 3 Drawing Figures

MINIATURE PORTABLE PUBLIC ADDRESS SYSTEM

BACKGROUND OF THE INVENTION

1. Field of the Invention

The present invention relates generally to sound amplifying devices and more particularly, to an improved portable, self-contained, public address apparatus.

2. Description of the Prior Art

Public address systems are often used in conjunction with guided tours. Motor buses, used for such tours, usually have a public address system built in to allow the tour director to speak to the members of the tour while they are being transported from one site to another.

Upon arriving at a tour site, the director and members of the tour usually leave the bus, which makes the public address system in the bus ineffective for broadcasting announcements. In order to realize the benefits of public address when the group is out-of-doors, devices such as bullhorns have been used. These heavy, cumbersome, and expensive devices can restrict the activities of the director by being physically demanding, and can be lost, stolen or misplaced easily.

Moreover, a duplication of public address systems is necessary because the built-in systems in the motor buses cannot be removed. Further, due to their non-removability, the bus systems are subject to vandalism, theft, and destruction from accidents as well as other causes. Since these systems are typically mounted within the body or chassis of the bus, they are also difficult and costly to repair.

SUMMARY OF THE PRESENT INVENTION

It is therefore an object of the present invention to provide a small, inexpensive, portable, light-weight public address system.

It is also an object of the present invention to provide a public address system for use in a motor bus which may be removed from the bus for use elsewhere.

Briefly, the preferred embodiment of the present invention includes a microphone, an amplifier circuit for amplifying voice signals from the microphone, a speaker for converting the electrical energy from the amplifier circuit into amplified sound waves, a power supply for supplying power to the amplifier circuit and the speaker, an input jack for connecting an auxiliary sound source such as a radio, tape player or a remote microphone to the amplifier circuit, a three-position switch, for turning the system ON, OFF or AUXILIARY, a volume control for controlling the amplification of the amplifier circuit, a connector for connecting an external power supply and speaker to the apparatus, and a power converter for converting AC power into a DC form usable by the apparatus for use in an auditorium or classroom.

The invention is designed to be used with any 12-24 volt electrical system of a motor bus, and also to use loudspeakers mounted inside the bus. Additionally, the unit can be removed from the bus and used in a building or out-of-doors. The unit can be powered by normal AC power through the use of a power converter, or when neither the vehicle's electrical system or AC power is available, the unit may be powered by batteries (12-24 volts) mounted within the portable speaker case.

An advantage of the presnt invention is its subminiature size which allows the amplifier, controls and microphone components to be carried in a shirt pocket.

Another advantage of the present invention is its light weight which allows the complete unit, including the speaker and power supply, to be carried easily.

Still another advantage of the present invention is its portability which allows it to be used in a variety of locations.

IN THE DRAWING

DETAILED DESCRIPTION OF THE PREFERRED EMBODIMENTS

Figure 1:
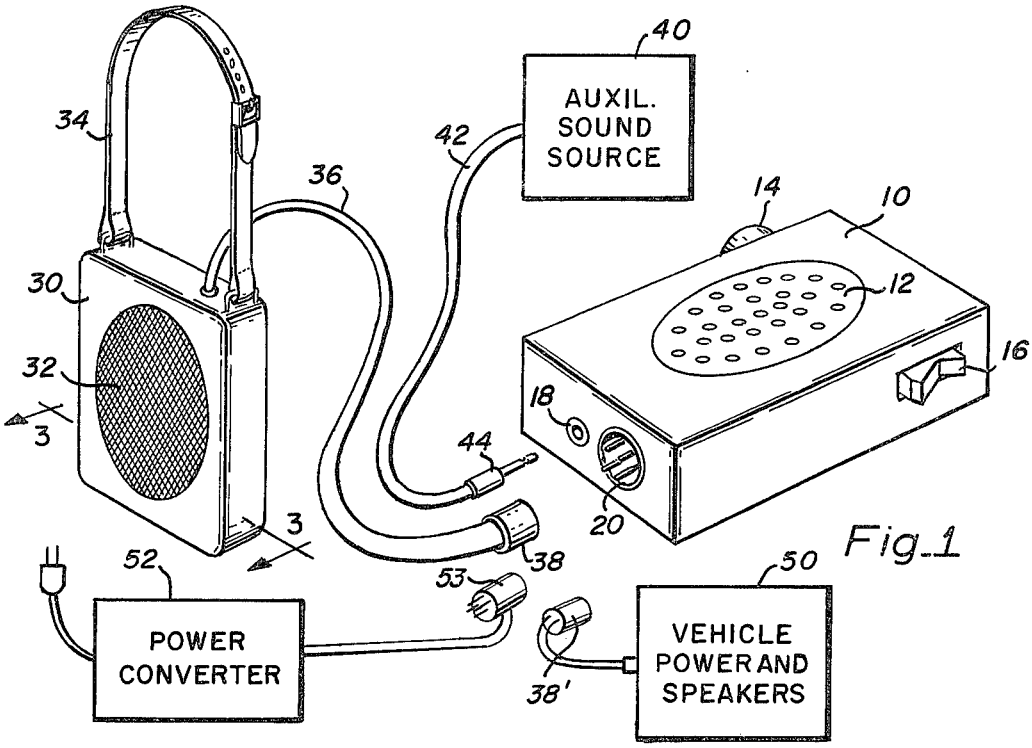
FIG. 1 is an isometric and partial block diagram view showing the principal components of the present invention.

Referring now to FIG. 1 of the drawing, an isometric and partial block diagram view is shown generally illustrating the principal components of a public address system in accordance with the present invention. The system includes an amplifier and contrl housing 10 having a built-in microphone 12, a volume control knob 14, a three-position rocker-type switch 16, an input jack 18, and a set of connector prongs 20. The overall size of housing 10 approximates that of a pack of cigarettes so that it may be easily carried in a shirt pocket. Also shown in FIG. 1 is a portable speaker case 30 having a loudspeaker 32, a carrying strap 34, and a cable 36 with an end 38 for receiving prongs 20; an auxiliary sound source 40 having a cable 42 with an end plug 44 for engaging jack 18; a vehicle power supply and set of speakers 50 which connect with prongs 20 and may be used in place of power pack 30; and a power converter 52.

Switch 16 allows two methods of operation. First, the system may be operated by depressing switch 16 into a first operating position which energizes the system and connects the microphone 12 to the amplifier input. This method would be used when announcements at various times were being made.

Second, by placing switch 16 in a second operating position, an auxiliary input source will be coupled to the amplifier input.

In its most basic mode of operation, cable end 38 is connected to prongs 20 and switch 16 is set to one of its ON positions so that power supplied from batteries inside case 30 energize the amplifier circuitry contained within the housing 10. When the tour director speaks into microphone 12 his voice is amplified and output through speaker 32. Knob 14 is used to adjust the volume output of speaker 32 to a desirable level. This mode of operation would be used when the tour and director are out-of-doors and when no alternative souces of power are available.

Alternatively, when, for example, the system is to be used inside a bus or other transportation means, the vehicle power and speakers 50 may be utilized. In this embodiment, the vehicle's power and speakers 50 are connected to the appropriate prongs of jack 20 so that the veicle's power drives the amplifier circuitry and the speakers, rather than the batteries contained in case 30.

Thus, the battery supply of case 30 can be saved until the operator is unable to use a suitable auxiliary power source.

In still another configuration, a power converter 52 having special adapter plug 53 might be used to convert AC power into 112-volt DC power. This source is then used to drive the amplifier circuitry and speaker 32 whose plug end 38 is mated with the male prongs of adapter 53. Thus, the public address sytem may be used in auditoriums or other buildings or areas which have access to AC power without running down the batteries contained in case 30.

Also shown in FIG. 1 is an auxiliary sound source 40. This sound source can be a radio, a microphone or other source of electronic sound impulses. Signals from source 40 are fed into the amplifier circuitry by inserting plug 44 into input jack 18 and moving switch 16 into its second operating position. The amplifier cirlcuitry of the present invention then amplifies these signals and outputs them through output speaker 32. An auxiliary source may be used with power to the amplifier circuit being supplied by the batteries in case 30 when the director is away from other available sources of power; with an alternate source of power 50 when the operator is inside a vehicle; or with power converter 52 when the director has AC power available.

Figure 2:
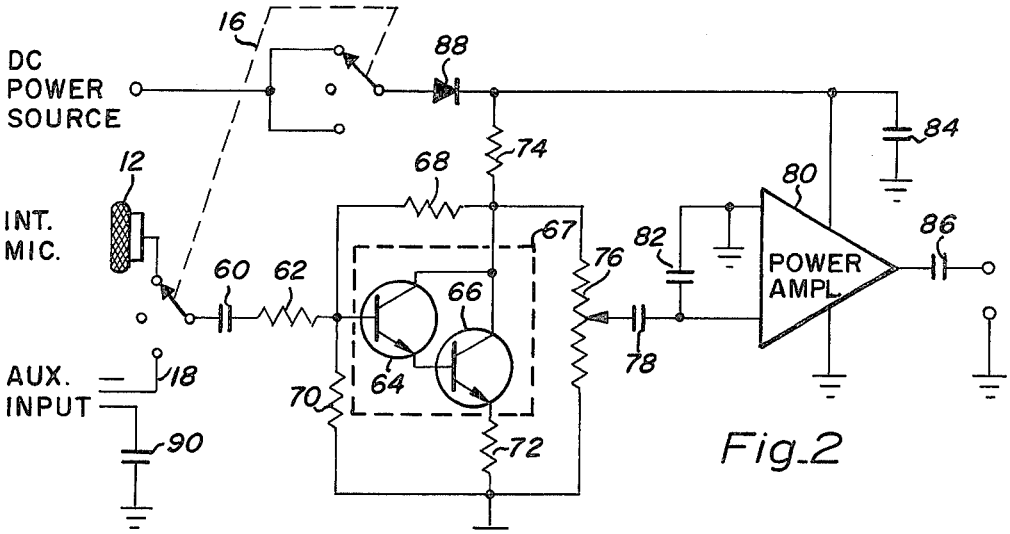
FIG. 2 is a schematic diagram illustrating the electronic components which make up the amplifier circuit of the present invention.

FIG. 2 shows, in schematic representation, the electronic circuitry contained within the housing 10. The circuit includes switch 16, auxiliary input jack 18, an input coupling capacitor 60, an input resistor 62, a pre-amplifier including a pair of transistors 64 and 66 arranged in Darlington configuration, a feedback resistor 68, a set of biasing resistors 70, 72, and 74, an adjustable output load resistor 76, an input coupling capacitor 78, a power amplifier 80, a damping capacitor 82, an isolating capacitor 84, an output coupling capacitor 86, a diode 88 and a DC blocking capacitor 90.

In a preferred embodiment the following components having the following values have been found to give satisfactory performance.

| | |
|---|---|
| capacitor 60 | .05 micro farad |
| resistor 62 | 68K ohms |
| resistor 68 | 1.8M ohms |
| resistor 70 | 820K ohms |
| resistor 72 | 270 ohms |
| resistor 74 | 470K ohms |
| resistor 76 | 0-1M ohms |
| capacitor 78 | .05 micro farad |
| capacitor 82 | 470 pico farad |
| capacitor 84 | 10 micro farad |
| capacitor 86 | 50 micro farad |
| capacitor 90 | 10 micro farad |

Two integrated circuits are also used; transistor 64 and 66 are included in a 2N5306; and amplifier 80 is a National Semiconductor LM380.

Input signals received from microphone 12 are fed through blocking capacitor 60 and isolation resistor 62 to transistor 64. Transistor 64 is combined with transistor 66 in a Darlington configuration 67 to provide a circuit with a high input impedance suitable for matching with microphone 12. Resistors 70, 72, and 74 provide the appropriate voltage bias to transistors 64 and 66 for proper operation of circuit 67.

This configuration provides many advantages which could only be achieved previously by using field-effect transistors (FET). The circuit 67, as used here, provides pre-amplification of the signal voltage as well as impedance matching, i.e., high input impedance and voltage amplification. Additionally, the circuit provides a higher amplification ratio than is normally available using FETS.

Overall amplification is controlled by adjusting the output voltage level of circuit 67. The output of circuit 67 is developed across resistor 76 which is a potentiometer adjustable by knob 14 on the outside of housing 10 (See FIG. 1). The amplified signal from circuit 67 is applied through blocking capacitor 78 to the integrated circuit power amplifier 80 which amplifies the signal and outputs it through capacitor 86 to a loudspeaker (not shown). Capacitor 82 serves to prevent amplifier 80 from developing spurious oscillations and capacitor 84 decouples amplifier 80 from the power supply. Thus, by adjusting knob 14 the overall amplification ratio may be adjusted which in turn controls the level of sound developed by the speaker(s).

In this embodiment, an amplification ratio of approximately twenty-five may be achieved. Higher ratios are possible if the degenerative feedback through resistor 68 is reduced. However, feedback enhances signal stability and minimizes distortion.

Safeguards against failure are built into the system. Diode 88 provides protection to the system in the event that a wrong polarity DC voltage is inadvertently applied to the amplifier circuit. Capacitor 90 allows DC isolation of the system and provides a signal ground which enables the invention to be used with any number of vehicles having either negative or positive ground.

Figure 3:
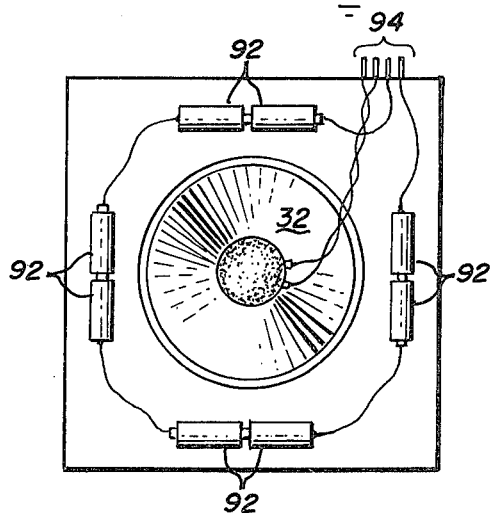
FIG. 3 is a view taken along the line 3—3 of FIG. 1 which depicts the internal components of the portable speaker case of the present invention.

Turning now to FIG. 3 of the drawing, a sectional view is shown of case 30 along the line 3—3. As illustrated, inside the housing of case 30 are four sets of pairs of 1 ½-volt dry cell batteries 92, a speaker 32, and a set of prongs 94. Batteries 92 are connected in series to provide a voltage supply equal to eight times 1 ½-volts or 12-volts. This voltage supply is output through two of the prongs 94. Speaker 32 is connected to two of the other prongs 94. One prong connected to speaker 32 and a prong connected to the battery supply are connected together to provide a ground for speaker 32.

In one configuration, cable 36 is connected to prongs 94 at one end and to prongs 20 at the other end. In this configuration, the 12-volt battery supply 92 contained inside case 30 energizes the amplifier circuitry and drives speaker 32. Signals received from built-in microphone 12 are thus amplified and broadcast through speaker 32 using power from batteries 92.

In another configuration, an auxiliary source 40, which may be a remote microphone, is attached via cable 42, plug 44 and jack 18. As previously described, the auxiliary source can then be selected using switch 16. In this configuration, power is still supplied to the circuit by the batteries 92. Signals received from the auxiliary microphone are amplified by the amplifier circuitry and again broadcast through speaker 32.

In still another configuration, a cable is connected to the 12-volt power supply and the speakers of a vehicle at one end and configured to connect with the appropriate prongs 20 at the other. Thus, either the built-in microphone 12 or an auxiliary source 40 can be used with a vehicle to broadcast information through the vehicle's speakers.

Even though several embodiments of the invention have been set forth by way of example, it is anticipated that numerous modifications and alterations will become apparent to those skilled in the art after having read the above disclosures. It is therefore intended that the following claims be interpreted to cover all such alterations and modifications as fall within the true spirit and scope of the invention.

What is claimed is:

1. In a motor bus including loud speakers mounted inside the bus, a sound amplifier connected to the speakers, and a DC power supply for providing electrical energy to the amplifier, an improved sound amplifier comprising:

a generally rectangular hand-held case having a plurality of first electrical connectors and a plurality of second electrical connectors;

transducer means contained within said case for converting sound waves into electrical impulses;

amplification means disposed within said case and connected to said transducer means for developing an amplified signal from the electtical impulses, said amplifier means also being connected to said first electrical connectors and including a first transistor and a second transistor in Darlington configuration, and a power amplifier to develop said amplified signal;

cable means for connecting said first electrical connectors to the bus's loud speakers and for connecting said second electrical connectors with the bus's power supply;

first switch means for connecting said amplification means to said second electrical connectors to allow electric current to flow from the bus's power supply to said amplification means;

second switch means for connecting said transducer means to the base of said first transistor; and volume control means connected to said amplification means for determining the magnitude of the amplified signal, said volume control means being mounted to said case and protruding therefrom so as to be externally accessible said sound amplifier being operative to cause sound waves contacting said transducer means to be amplified and broadcast over the motor bus loud speakers.

2. In a motor bus as recited in claim 1 wherein said case further includes an auxiliary input connector connected to said second switch means and said first and second switch means are ganged together by a three-position rocker actuator having a first position for intermittently allowing electric current to flow from the power supply and transducer means to said amplifier means, a second position for continuously allowing electric current to flow from the power supply and auxiliary input connector to said amplifier means, and a third position for not allowing electric current to flow from the power supply to said amplifier means.

3. In a motor bus as recited in claim 1 wherein said transducer means inlcudes a crystal microphone.

4. A public address sytem comprising:

electrical power means for providing electrical energy;

sound generating means for developing sound in response to an electrical signal;

a first case for housing said electrical power means and said sound generating means;

a firsft electrical connector passing through said first case and connected to said electrical power means;

a second electrical connector passing through said first case and connected to said sound generating means;

a second case, generally rectangular in shape;

transducer means for converting sound waves into electrical impulses, said transducer means mounted to said second case;

amplification means connected to said transducer means for amplifying the electrical impulses into an amplified signal, said amplification means being mounted within said second case and including a first transistor and a second transistor in Darlington configuration and a power amplifier connected to the output of said second transistor;

a third electrical connector passing through said second case and having a first group of terminals connected to the power input terminals of said amplification means and a second group of terminals connected to the output terminals of said amplifier;

amplification control means connected to said amplification means for controlling the magnitude of the electrical signal, said amplification control means mounted to said second case so as to partially protrude therefrom;

cable means for connecting said first electrical connector to said first group terminals and said second electrical connector to said second group terminals; and switch means connected to said amplifier means and said third electrical connector for allowing current to flow from said electrical power means to said amplification means, said switch means mounted to said second case so as to protrude therefrom, whereby sound waves contacting said transducer means are amplified by said amplification means and broadcast by said sound generating means.

5. A public address system as recited in claim 4 wherein said electrical power means includes a plurality of dry-cell batteries.

6. A public address system as recited in claim 4 wherein said electrical power means includes power conversion means for converting AC power into DC power.

7. A public address system as recited in claim 4 wherein said electrical power means includes means for connection to a vehicular electrical system.

8. A public address system as recited in claim 4 wherein said switch means includes a multi-position switch having a first, second and third position for intermittent open, continuous open, and continuous closed operation, respectively.

* * * * *